US006792902B2

(12) United States Patent
Simpson

(10) Patent No.: US 6,792,902 B2
(45) Date of Patent: Sep. 21, 2004

(54) EXTERNALLY MOUNTED DPCS (DIFFERENTIAL PRESSURE CONTROL SYSTEM) WITH POSITION SENSOR CONTROL TO REDUCE FRICTIONAL AND MAGNETIC HYSTERESIS

(75) Inventor: Roger Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 2 days.

(21) Appl. No.: 10/281,799

(22) Filed: Oct. 28, 2002

(65) Prior Publication Data

US 2003/0196618 A1 Oct. 23, 2003

Related U.S. Application Data

(60) Provisional application No. 60/374,532, filed on Apr. 22, 2002.

(51) Int. Cl.[7] ..... F01L 1/34

(52) U.S. Cl. ..... 123/90.15; 123/90.16; 123/90.17

(58) Field of Search ..... 123/90.15, 90.16, 123/90.17, 90.18, 90.27, 90.31; 464/1, 2, 160; 74/567, 568 R; 137/625.69

(56) References Cited

U.S. PATENT DOCUMENTS

| | | | | | |
|---|---|---|---|---|---|
| 4,116,321 | A | * | 9/1978 | Miller | 192/103 F |
| 4,635,682 | A | | 1/1987 | Walters | 137/625.64 |
| 5,107,804 | A | | 4/1992 | Becker et al. | 123/90.17 |
| 5,167,206 | A | * | 12/1992 | Suga | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,244,002 | A | * | 9/1993 | Frederick | 137/1 |
| 5,367,992 | A | * | 11/1994 | Butterfield et al. | 123/90.17 |
| 5,497,738 | A | * | 3/1996 | Siemon et al. | 123/90.17 |
| 6,024,062 | A | * | 2/2000 | Kako et al. | 123/90.17 |
| 6,109,284 | A | * | 8/2000 | Johnson et al. | 137/1 |
| 6,571,757 | B1 | * | 6/2003 | Simpson | 123/90.11 |

FOREIGN PATENT DOCUMENTS

| | | | |
|---|---|---|---|
| DE | 4415524 A1 | 11/1994 | F01L/1/34 |
| EP | 0364069 A1 | 7/1989 | F01L/31/22 |
| EP | 0439433 A1 | 7/1991 | F15B/21/08 |

OTHER PUBLICATIONS

Roger Simpson, Phaser Mounted DPCS to Reduce Axial Length of the Engine, US patent application Pub. US 2003/0196616 A1, Oct. 23, 2003.*

* cited by examiner

*Primary Examiner*—Thomas Denion
*Assistant Examiner*—Ching Chang
(74) *Attorney, Agent, or Firm*—Brown & Michaels PC; Greg Dziegielewski

(57) ABSTRACT

The cam phaser of the present invention includes an externally mounted DPCS (234) with spool position feedback to control the position of a center mounted spool valve (192) and control the phase angle of the cam mounted phaser. A position sensor (300) is mounted to the spool valve position such that a control loop (400) controls the position of the spool valve (192). A second, outer loop (430) controls the phaser angle. An offset is preferably added to the spool valve position to move the spool valve to its steady state or null position. This null position is required so that the spool (200) can move in to move the phaser in one direction and outward to move the phaser in the other direction. This type of system reduces any frictional or magnetic hysteresis in the system.

20 Claims, 3 Drawing Sheets

EXTERNALLY MOUNTED DPCS (DIFFERENTIAL PRESSURE CONTROL SYSTEM) WITH POSITION SENSOR CONTROL TO REDUCE FRICTIONAL AND MAGNETIC HYSTERESIS

REFERENCE TO RELATED APPLICATIONS

This application claims an invention which was disclosed in U.S. Provisional Application No. 60/374,532, filed Apr. 22, 2002, entitled "Externally Mounted DPCS (Differential Pressure Control System) with Position Sensor Control to Reduce Frictional and Magnetic Hysteresis". The benefit under 35 USC §119(e) of the United States provisional application is hereby claimed, and the aforementioned application is hereby incorporated herein by reference.

BACKGROUND OF THE INVENTION

1. Field of the Invention

The invention relates to a hydraulic control system for controlling the operation of a variable camshaft timing (VCT) system. More specifically, the present invention relates to a control system that utilizes a position sensor mounted to a differential pressure control system (DPCS) with a centrally mounted spool valve and a control loop controlling the position of the spool valve.

2. Description of Related Art

U.S. Pat. No. 5,107,804 shows one method of how to control the position of a spool valve that controls the oil flow to and from the chambers of a vane or piston style cam phaser by using an externally mounted solenoid Differential Pressure Control System (DPCS). The DPCS utilizes engine oil pressure to push against one end of a spool valve. A control pressure pushes against the other side and comes from either a PWM or a proportional solenoid.

The control system disclosed in both U.S. Pat. Nos. 5,172,659 and 5,184,578 utilizes hydraulic force on both ends of the spool valve. U.S. Pat. No. 5,184,578 shows the control system, in which crank and cam positions are sensed and a Pulse-Width Modulated Solenoid moves a spool valve to control the actuation of the phaser, with a closed-loop control measuring the phase difference between cam and crank and the operating spool valve accordingly.

FIG. 1 shows a block diagram of a cam torque actuated variable cam timing device with a differential pressure control system (DPCS). The Engine Control Unit (ECU) (1) decides on a phase set point (2) based on various demands on the engine and system parameters (temperature, throttle position, oil pressure, engine speed, etc. . . . ). The set point is filtered (3) and combined (4) with a VCT phase measurement (12) in a control loop with a PI controller (5), phase compensator (6), and anti-windup logic (7). The output of this loop is combined (9) with a null duty cycle signal (8) into a Pulse Width Modulated (PWM) valve (206) that provides physical pressure (340) to the Differential Pressure Control System (DPCS) (234), along with oil pressure from the main oil gallery or supply (230) to push the center mounted spool valve. The spool valve (192), in turn, controls fluid (engine oil) to activate the VCT phaser (14), either by applying oil pressure to the vane chambers or by switching passages to allow cam torque pulses to move the phaser (14). The cam position is sensed by a cam sensor (20), and the crank position (or the position of the phaser drive sprocket, which is connected to the crankshaft) is also sensed by the sensor (21), and the difference between the two is used by a VCT phase measurement circuit (19) to derive a VCT phase signal (12), which is fed back to complete the loop.

One problem with this system is that the pulse width modulated (PWM) valve and the DPCS (234) with the center mounted spool valve have both frictional and magnetic hysteresis. As the duty cycle (320) or pulse width modulated signal increases and enters the pulse width modulator (206), the physical pressure (340) that results will be different then when the duty cycle (320) decreases, creating frictional hysteresis, as shown in graph (360) of FIG. 1. The pressure (340) then feeds into the DPCS (234), which determines the position of the center mounted spool valve (192). As a result, as the duty cycle (320) increases or decreases, different positions of the spool valve (192) results, creating magnetic hysteresis, as shown in graph (370) of FIG. 1.

Therefore, there is a need in the art for a system, which minimizes errors due to frictional and magnetic hysteresis.

SUMMARY OF THE INVENTION

The cam phaser of the present invention includes a differential pressure control system (DPCS) with spool position feedback to control the position of a center mounted spool valve and control the phase angle of the cam mounted phaser. A position sensor is mounted to the spool valve position such that a control loop controls the position of the spool valve. A second outer loop controls the phase angle. An offset is preferably added to the spool valve position to move the spool valve to its steady state or null position. This null position is required so that the spool can move in to move the phaser in one direction and move out to move the phaser in the other direction. This type of system reduces any frictional or magnetic hysteresis in the system.

DETAILED DESCRIPTION OF THE INVENTION

The present invention reduces the error created by the prior art by having a position sensor mounted to the spool valve position, of a differential pressure control system (DPCS), and a feedback control loop controlling the position of the spool valve. This method reduces any frictional or magnetic hysteresis in the system. There is also preferably a second, outer feedback loop to control the phaser angle. The inner loop controls the spool valve position, while the outer loop controls the phase angle. An offset is preferably added to the spool valve position to move the spool valve to its steady state or null position. The null position is required so that the spool can move in to move the phaser in one direction and move out to move the phaser in the other direction. The "phaser" is the variable cam timing (VCT) component, which allows the position of the camshaft (126) to be varied in phase relative to the crankshaft also known as a "cam indexer."

Pressure and viscosity of the hydraulic fluid that is used in the control system, illustratively engine lubricating oil in an automotive VCT application, can change over a period of time due to changes in the engine rpm, the operating temperature or age of the oil, or variations in the composition of the engine oil from time to time as a result of an oil change in which the old oil is replaced by an oil of a different brand or grade. In a control system that relies on an hydraulic force of variable magnitude to counteract a mechanical force, the actual hydraulic control pressure, which is at least partly related to viscosity in a dynamic system, is maintained at a predetermined value by changing the duty cycle which is inputted into the pulse width modulated (PWM) valve. The PWM valve, is used to control the hydraulic pressure at a reduced level from a higher pressure source, for example, the oil supply, based on the duration of the "on" cycles of the PWM valve relative to its "off" cycles.

Figure 2:
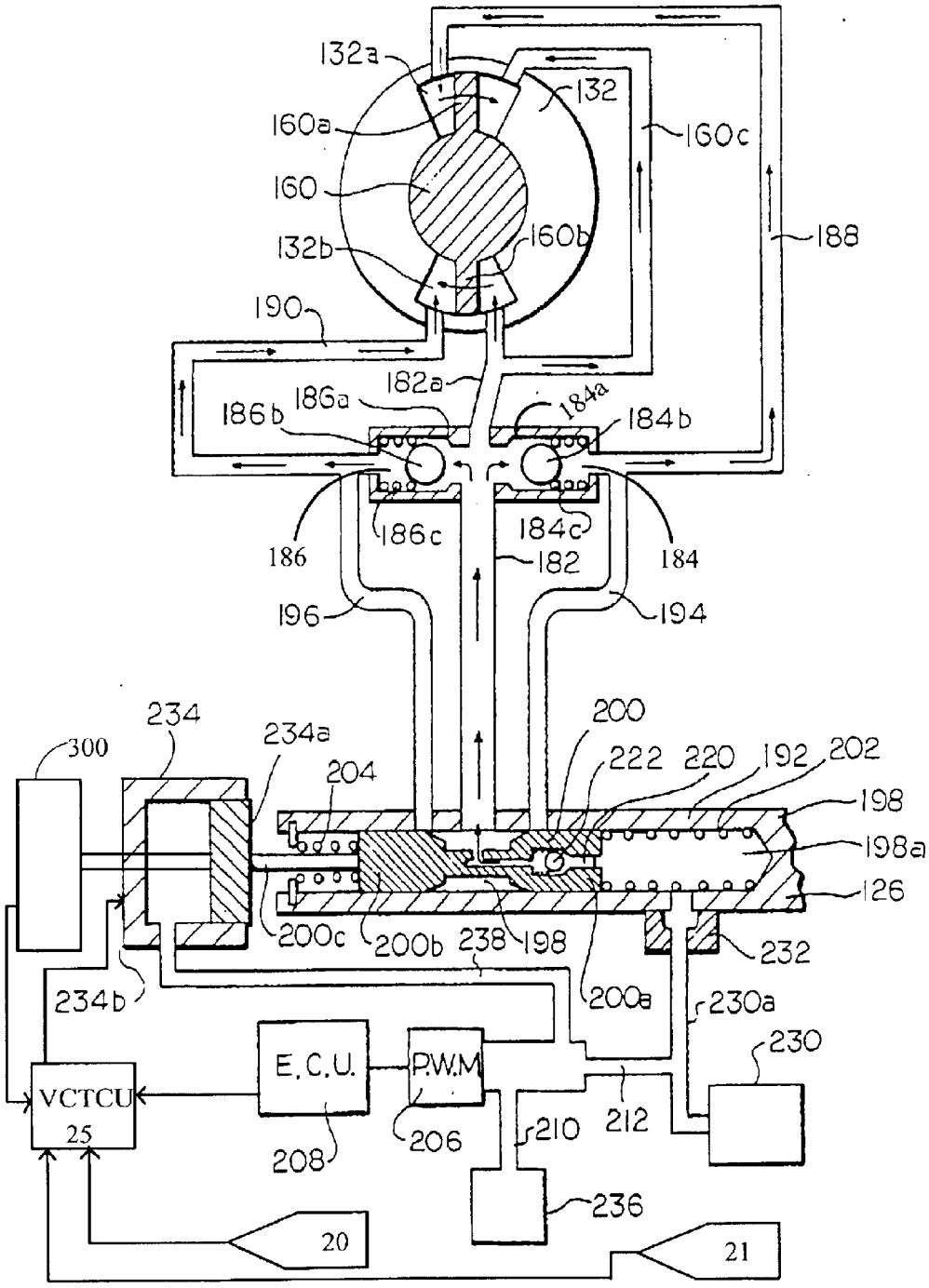
FIG. 2 is a schematic view of the variable camshaft timing arrangement containing the present invention.

FIG. 2 shows a cam phaser of present invention in which a housing in the form of a sprocket (132) is oscillatingly journalled on a camshaft (126). The camshaft (126) may be considered to be the only camshaft of a single camshaft engine, either of the overhead camshaft type or the in block camshaft type. Alternatively, the camshaft (126) may be considered to be either the intake valve operating camshaft or the exhaust valve operating camshaft of a dual camshaft engine. In any case, the sprocket (132) and the camshaft (126) are rotatable together, and are caused to rotate by the application of torque to the sprocket (132) by an endless roller chain, which is trained around the sprocket (132) and also around a crankshaft with its own sprocket. As will be hereinafter described in greater detail, the sprocket (132) is oscillatingly journalled on the camshaft (126) so that is oscillatable at least through a limited arc with respect to the camshaft (126), an action which will adjust the phase of the camshaft (126) relative to the crankshaft.

An annular pumping vane is fixedly positioned on the camshaft (126), the vane having a diametrically opposed pair of radially outwardly projecting lobes (160*a*), (160*b*) and being attached to an enlarged end portion of the camshaft (126) by bolts which pass through the vane (160) into the end portion. The lobes (160*a*), (160*b*) are received in radially outwardly projecting recesses (132*a*), (132*b*), respectively, of the sprocket (132), the circumferential extent of each of the recesses (132*a*), (132*b*) being somewhat greater than the circumferential extent of the vane lobe (160*a*), (160*b*) which is received in such recess to permit limited oscillating movement of the sprocket (132) relative to the vane (160). Each of the recesses (132*a*), (132*b*) of the sprocket (132) is capable of sustaining hydraulic pressure, and within each recess (132*a*), (132*b*), the portion on each side of the lobe (160*a*), (160*b*), respectively, is capable of sustaining hydraulic pressure.

In any case, hydraulic fluid, illustratively in the form of engine lubricating oil, flows into the recesses (132*a*), (132*b*) by way of a common inlet line (182). The inlet line (182) terminates at a juncture between opposed check valves (184) and (186), which are connected to the recesses (132*a*), (132*b*), respectively, by branch lines (188), (190), respectively. The check valves (184), (186) have annular seats (184*a*), (186*a*), respectively, to permit the flow of hydraulic fluid through the check valves (184), (186) into the recesses (132*a*), (132*b*), respectively. The flow of hydraulic fluid through the check valves (184), (186) is blocked by floating balls (184*b*), (186*b*), respectively, which are resiliently urged against the seats (184*a*), (186*a*), respectively, by springs (184*c*), (186*c*), respectively. The check valves (184), (186), thus, permit the initial filling of the recesses (132*a*), (132*b*) and provide for a continuous supply of make-up hydraulic fluid to compensate for leakage therefrom. Hydraulic fluid enters the line (182) by way of a spool valve (192), which is incorporated within the camshaft (126), and hydraulic fluid is returned to the spool valve (192) from the recesses (132*a*), (132*b*) by return lines (194), (196), respectively.

The spool valve (192) is made up of a cylindrical member (198) and a spool (200), which is slidable to and fro within the member (198). The spool (200) has cylindrical lands (200*a*) and (200*b*) on opposed ends thereof, and the lands (200*a*) and (200*b*), which fit snugly within the member (198), are positioned so that the land (200*b*) will block the exit of hydraulic fluid from the return line (196), or the land (200*a*) will block the exit of hydraulic fluid from the return line (194), or the lands (200*a*) and (200*b*) will block the exit of hydraulic fluid from both the return lines (194) and (196), as is shown in FIG. 2, where the camshaft (126) is being maintained in a selected intermediate position relative to the crankshaft of the associated engine.

The position of the spool (200) within the member (198) is influenced by an opposed pair of springs (202), (204) which act on the ends of the lands (200*a*), (200*b*), respectively. Thus, the spring (202) resiliently urges the spool (200) to the left, in the orientation illustrated in FIG. 2, and the spring (204) resiliently urges the spool (200) to the right in such orientation. The position of the spool (200) within the member (198) is further influenced by a supply of pressurized hydraulic fluid within a portion (198*a*) of the member (198), on the outside of the land (200*a*), which urges the spool (200) to the left. The portion (198*a*) of the member (198) receives its pressurized fluid (engine oil) directly from the oil supply (230) of the engine by way of a conduit (230*a*), and this oil is also used to lubricate a bearing (232) in which the camshaft (126) of the engine rotates.

The control of the position of the spool (200) within the member (198) is in response to hydraulic pressure within a control pressure cylinder (234) whose piston (234*a*) bears against an extension (200*c*) of the spool (200). The surface area of the piston (234*a*) is greater than the surface area of the end of the spool (200), which is exposed to hydraulic pressure within the portion (198), and is preferably twice as great. Thus, the hydraulic pressures which act in opposite directions on the spool (200) will be in balance when the pressure within the cylinder (234) is one-half that of the pressure within the portion (198*a*), assuming that the surface area of the piston (234*a*) is twice that of the end of the land (200*a*) of the spool. This facilitates the control of the position of the spool (200) in that, if the springs (202) and (204) are balanced, the spool (200) will remain in its null or centered position, as illustrated in FIG. 2, with less than full engine oil pressure in the cylinder (234), thus allowing the spool (200) to be moved in either direction by increasing or decreasing the pressure in the cylinder (234), as the case may be. A position sensor (300) is mounted so as to sense the position of the spool valve (192).

The pressure within the cylinder (234) is controlled by a valve (206), preferably of the pulse width modulated type (PWM), in response to a control signal from an electronic engine control unit (ECU) (208), shown schematically, which may be of conventional construction. With the spool (200) in its null position when the pressure in the cylinder (234) is equal to one-half the pressure in the portion (198*a*), as heretofore described, the on-off pulses of the valve (206) will be of equal duration; by increasing or decreasing the on duration relative to the off duration, the pressure in the cylinder (234) will be increased or decreased relative to such one-half level, thereby moving the spool (200) to the right or to the left, respectively. The valve (206) receives engine oil from the oil supply (230) through an inlet line (212) and selectively delivers engine oil from such source to the cylinder (234) through a supply line (238). Excess oil from the valve (206) is drained to a sump (236) by way of a line (210).

By using imbalances between oppositely acting hydraulic loads from a common hydraulic source on the opposed ends of the spool (200) to move it in one direction or another, as opposed to using imbalances between an hydraulic load on one end and a mechanical load on an opposed end, the control system of FIG. 2 is capable of operating independently of variations in the viscosity or pressure of the hydraulic system. Thus, it is not necessary to vary the duty cycle of the valve (206) to maintain the spool (200) in any given position, for example, in its centered or null position, as the viscosity or pressure of the hydraulic fluid changes during the operation of the system. In that regard, it is to be understood that the centered or null position of the spool (200) is the position where no change in camshaft to crankshaft phase angle is occurring, and it is important to be able to rapidly and reliably position the spool (200) in its null position for proper operation of a VCT system.

Make-up oil for the recesses (132*a*), (132*b*) of the sprocket (132) to compensate for leakage therefrom is provided by way of a small, internal passage (220) within the spool (200), from the passage (198*a*) to an annular space (198*b*) of the cylindrical member (198), from which it can flow into the inlet line (182). A check valve (222) is positioned within the passage (220) to block the flow of oil from the annular space (198*b*) to the portion (198*a*) of the cylindrical member (198).

The vane (160) is alternatingly urged in clockwise and counterclockwise directions by the torque pulsations in the camshaft (126) and these torque pulsations tend to oscillate the vane (160), and, thus, the camshaft (126), relative to the sprocket (132). However, in the FIG. 2 position of the spool (200) within the cylindrical member (198), such oscillation is prevented by the hydraulic fluid within the recesses (132*a*), (132*b*) of the sprocket (132) on opposite sides of the lobes (160*a*), (160*b*), respectively, of the vane (160), because no hydraulic fluid can leave either of the recesses (132*a*), (132*b*), since both return lines (194), (196) are blocked by the position of the spool (200), in the FIG. 2 condition of the system. If, for example, it is desired to permit the camshaft (126) and vane (160) to move in a counterclockwise direction with respect to the sprocket (132), it is only necessary to increase the pressure within the cylinder (134) to a level greater than one-half that in the portion (198*a*) of the cylindrical member. This will urge the spool (200) to the right and thereby unblock the return line (194). In this condition of the apparatus, counterclockwise torque pulsations in the camshaft (126) will pump fluid out of the portion of the recess (132*a*) and allow the lobe (162*a*) of vane (160) to move into the portion of the recess which has been emptied of hydraulic fluid. However, reverse movement of the vane will not occur as the torque pulsations in the camshaft become oppositely directed unless and until the spool (200) moves to the left, because of the blockage of fluid flow through the return line (196) by the land (200*b*) of the spool (200).

Further, the passage (182) is provided with an extension (182*a*) to the non-active side of one of the lobes (160*a*), (160*b*), shown as the lobe (160*b*), to permit a continuous supply of make-up oil to the non-active sides of the lobes (160*a*), (160*b*) for better rotational balance, improved damping of vane motion, and improved lubrication of the bearing surfaces of the vane (160). It is to be noted that the supply of make-up oil in this manner avoids the need to route the make-up oil through the valve (206). Thus, the flow of make-up oil does not affect, and is not affected by, the operation of the valve (206). Specifically make-up oil will continue to be provided to the lobes (160*a*), (160*b*) in the event of a failure of the valve (206), and it reduces the oil flow rates that need to be handled by the valve (206).

The VCT control unit (25) of the invention preferably uses inputs as signals from a sensor (21) adjacent to the crankshaft and another sensor (20) adjacent to the phaser or camshaft (126), to sense the relative phase of the camshaft (126) and crankshaft. The position sensor (300) forms another input into the VCT control unit (25), which functions as will be explained in connection with FIG. 3 below.

Although the position sensor (300) physically contacts the DPCS (234), physical contact is not necessary. For example, the position sensor (300) could be optically, capacitively or magnetically coupled to the DPCS (234), and might be built into the PWM. Positions sensors (300) which could be utilized in this invention include, but are not limited to, linear potentiometers, hall effect sensors, and tape end sensors.

Figure 3:
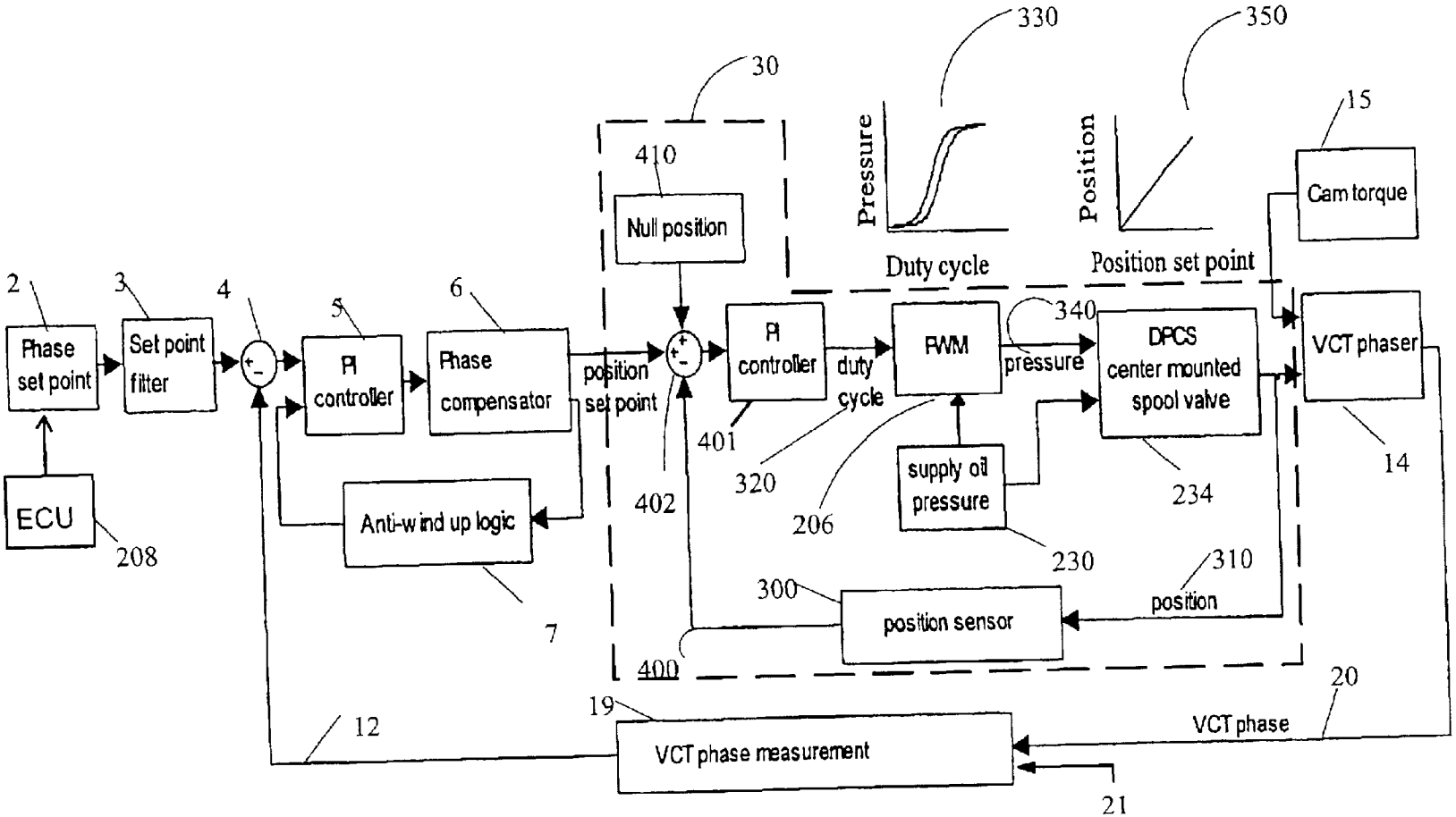
FIG. 3 is a flowchart of a cam torque actuated variable cam timing device with a differential pressure control system (DPCS) and spool valve position feedback of the present invention.

FIG. 3 shows a block diagram of a control circuit of the invention, which uses a feedback loop to control the position of the spool valve, and thereby reduce frictional and magnetic hysteresis in the system. A second feedback loop controls the phaser angle. The inner loop (30) controls the spool valve position and the outer loop (similar to that shown in FIG. 1) controls the phase angle. An offset is preferably added to the spool valve position. This null position is required so that the spool can move in to move the phaser in one direction and outward to move the phaser in the other direction.

Figure 1:
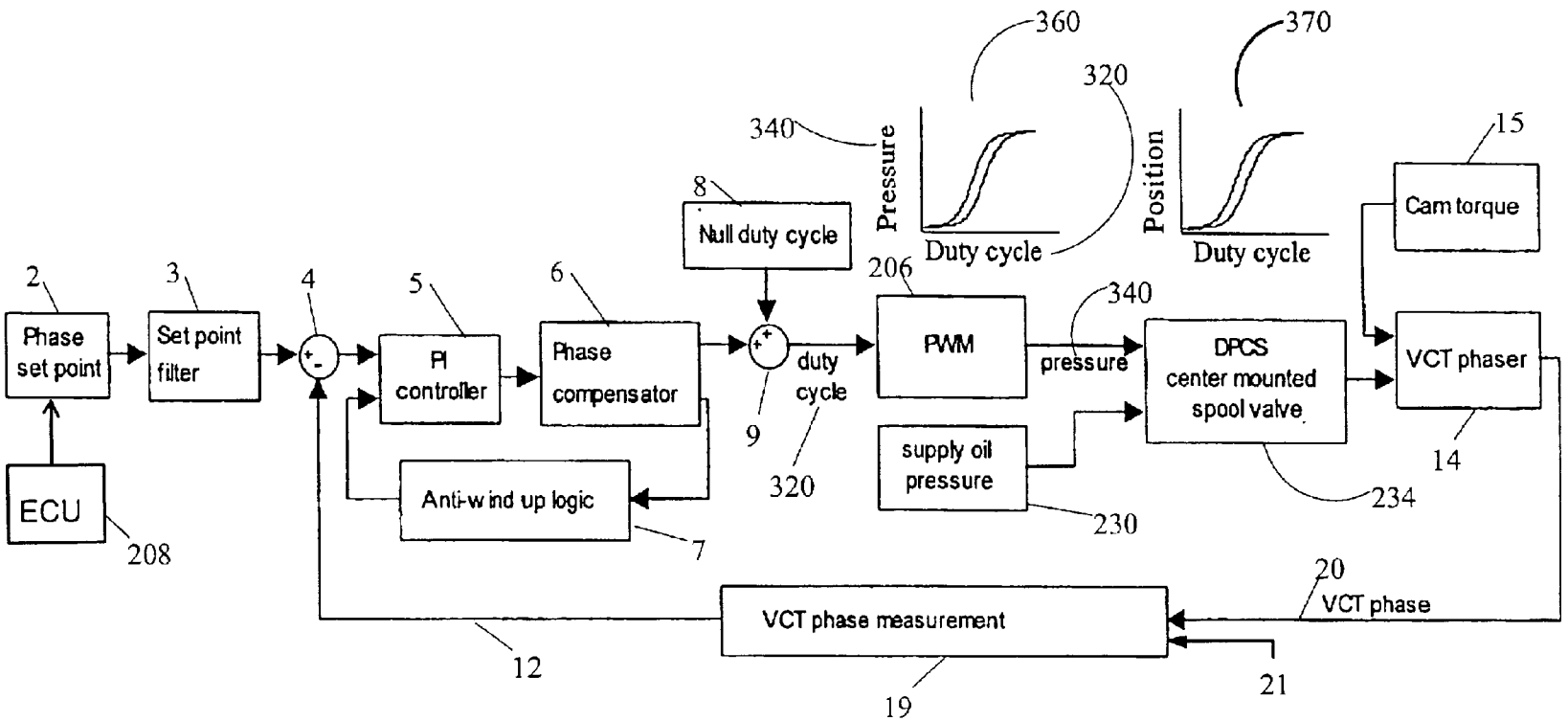
FIG. 1 PRIOR ART
FIG. 1 is a flow chart of a cam torque actuated variable cam timing device with a differential pressure control system (DPCS).

The basic phaser control loop of FIG. 3 is the same as FIG. 1, and where the figures are the same, the circuit will not be discussed separately. The difference between the invention shown in FIG. 3 and the prior art of FIG. 1 lies in the inner control loop (30), which starts with the output of the phase compensator (6). The output of the compensator (6) is combined (402) with a null position offset (410) and the output of the spool position sensor (300), and input to the PI controller (401). The output of the PI controller (401) is a pulse modulated signal or a duty cycle (320), which inputs into a PWM (206) along with pressure from the oil supply (230). The output of the PWM (206) is physical pressure (340), which inputs into the DPCS (234), along with oil pressure (238) from the oil supply (230), both of which drive the center mounted spool valve. The position (310) of the center mounted spool valve is read by the position sensor (300) and the output (400) of the position sensor (300) is fed back to complete the loop (30).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner potion and the outer portion being controllable in response to a fluid control input, such that the relative phase of the crankshaft and at least one camshaft can be shifted by varying the fluid at the fluid control input of the variable cam phaser, the variable cain timing system comprising:

a spool valve (192) comprising a spool slidably mounted with a first end connected to a hydraulic fluid supply (236) and a second end being a differential pressure control system (DPCS) (234), where the DPCS (234) comprises a hydraulic piston, influenced by the amount of hydraulic fluid pressure from the hydraulic fluid supply (236), with a surface area that is twice the amount of surface area of the spool valve (192) it presses against, wherein the spool, being centrally located within the inner portion of the variable cam phaser, such that the axial movement of the spool controls fluid flow at the fluid control input of the variable cain phaser;

a pulse width modulated (PWM) valve (206) having an electrical input and a sensor coupled to the spool such that an electrical signal at the electrical input causes axial movement of the spool;

a position sensor (300) coupled to the piston of the DPCS (234), having a position signal output representing the physical position of the spool within the spool valve (192);

VCT phase measurement sensors (20)(21) coupled to the crankshaft and the at least one camshaft controlled by the variable cam timing system;

a VCT control circuit comprising:

a cam phase input coupled to the VCT phase measurement sensors;

a phase set point input for accepting a signal representing a desired relative phase of the camshaft and crankshaft;

a spool valve position input coupled to the piston of the DPCS (234);

a signal processing circuit accepting signals from the phase set point input, the cam phase input, and the spool valve position input, such that when a phase set point signal is applied at the phase set point input, the control circuit provides an adjusted duty cycle (320) for the pulse width modulated valve (206), which influences the DPCS (234) to move the spool within the spool valve (192) to control the variable cam phaser to shift the phase of the camshaft as selected by the phase set point signal.

2. The variable cam timing system of claim 1, wherein the sensor (300) is selected from the group consisting of a linear potentiometer, a hall effect sensor, and a tape end sensor.

3. The variable cam timing system of claim 1, wherein the piston of the DPCS (234) and the position sensor (300) are coupled by a means selected from the group consisting of physical coupling, an optical coupling, a magnetic coupling, and a capacitive coupling.

4. The variable cam timing system of claim 1, wherein the fluid comprises engine lubricating oil from a pressurized lubricating oil source.

5. The variable cam timing system of claim 1, in which the signal processing circuit comprises:

an outer loop controlling the phase angle, coupled to the set point input and the cam phase input;

an inner loop for controlling the spool valve position, coupled to the spool valve position input and the inner loop;

such that a duty cycle as set by the outer loop is modified by the inner loop based on the spool position.

6. The variable cam timing system of claim 5, in which:

a) the outer loop comprises:

i) ail anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase compensator, a third input, and an output;

iii) a second PI controller (401) having an input coupled to the output of the combiner and an output;

iv) a PWM valve (206) having an input coupled to the output of the second PI controller, an input from the fluid input controller and an output; and v) a DPCS (234) having an input coupled to the output of the PWM valve (206), an input from the supply (230), and an output; and b) the inner loop comprises coupling the spool position in-put to the third input of the combiner.

7. An internal combustion engine comprising:

a) a crankshaft;

b) at least one camshaft;

c) a cam drive connected to the crankshaft;

d) a variable cam phaser having an inner portion mounted to at least one camshaft and a concentric outer portion connected to the cam drive, the inner portion and the outer portion having relative angular positions being controllable in response to a fluid control in-put, such that the relative phase of the crankshaft and at least one camshaft can be shifted by varying the fluid at the fluid control input of the variable cam phaser; and e) a variable cam timing system comprising:

i) a spool valve (192) comprising a spool slidably mounted with a first end connected to a hydraulic fluid supply and a second end being a DPCS (234), where the DPCS (234) comprises a hydraulic piston, influenced by the amount of hydraulic fluid pressure from the hydraulic fluid supply (236), with a surface area that is twice the amount of surface area of the spool valve (192) it presses against, wherein the spool, being centrally located within the inner portion of the variable cam phaser, such that the axial movement of the spool controls fluid flow at the fluid control input of the variable cam phaser;

ii) a pulse width modulated (PWM) valve (206) having an electrical input and a sensor coupled to the spool such that an electrical signal at the electrical input causes axial movement of the spool;

iii) a position sensor (300) coupled to the piston of the DPCS (234), having a position signal output representing the physical position of the spool within the spool valve (192);

iv) VCT phase measurement sensors (20)(21) coupled to the crankshaft and the at least one camshaft controlled by the variable cam timing system;

v) a VCT control circuit comprising:

vi) a cam phase input coupled to the VCT phase measurement sensors;

vii) a phase set point input for accepting a signal representing a desired relative phase of the camshaft and crankshaft;

viii) a spool valve position input coupled to the piston of the DPCS (234);

ix) a signal processing circuit accepting signals from the phase set point input, the cam phase input, and the spool valve position input, such that when a phase set point signal is applied at the phase set point input, the control circuit provides an adjusted duty cycle (320) for the pulse width modulated valve (206), which influences the DPCS (234) to move the spool within the spool valve (192) to control the variable cam phaser to shift the phase of the camshaft as selected by the phase set point signal.

8. The internal combustion engine of claim 7, wherein the position sensor (300) is selected from the group consisting of a linear potentiometer, a hall effect sensor, and a tape end sensor.

9. The internal combustion engine of claim 7, wherein the piston of the DPCS (234) and the position sensor (300) are coupled by a means selected from the group consisting of physical coupling, an optical coupling, a magnetic coupling, and a capacitive coupling.

10. The internal combustion engine of claim 7, wherein the hydraulic fluid comprises engine lubricating oil from a pressurized hydraulic oil supply (230).

11. The internal combustion engine of claim 7, in which the signal processing circuit comprises:

an outer loop controlling the phase angle, coupled to the set point input and the cam phase input;

an inner loop for controlling the spool valve position, coupled to the spool valve position input and the inner loop;

such that a duty cycle as set by the outer loop is modified by the inner loop based on the spool position.

12. The internal combustion engine of claim 11, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase compensator, a third input, and an output;

iii) a second PI controller (401) having an input coupled to the output of the combiner and an output;

iv) a PWM valve (206) having an input coupled to the output of the second PI controller, an input from the hydraulic fluid supply (230) and an output; and v) a differential pressure control system cylinder (234) having an input coupled to the output of the PWM valve, an input from the hydraulic fluid supply (230), and an output; and b) the inner loop comprises coupling the spool position in-put to the third input of the combiner.

13. In an internal combustion engine having a variable camshaft timing system for varying phase angle of a camshaft relative to a crankshaft, a method of regulating the fluid flow from a source to a means for transmitting rotary movement from the crankshaft to a housing, comprising the steps of:

sensing the positions of the camshaft and crankshaft;

calculating a relative phase angle between the camshaft and crankshaft, the calculating step using an engine control unit for processing information obtained from the sensing step, the engine control unit further issuing an electrical signal corresponding to the phase angle;

controlling the position of a spool slidably positioned within a spool valve, the controlling step being in response to the signal received from the engine control unit, the controlling step utilizing a differential pressure control system to vary the position of the vented spool and a position sensor to sense a position of the spool;

wherein a first end of the spool is connected to a hydraulic fluid supply and a second end of the spool being the differential pressure control system, wherein the differential pressure control system comprises a hydraulic piston, influenced by the amount of hydraulic fluid pressure from the hydraulic fluid supply, with a surface area that is twice the amount of surface area of the spool valve it presses against, wherein the spool is centrally located within the inner portion of the variable cam phaser, such that the axial movement of the spool controls fluid flow at the fluid control input of the variable cam phaser;

wherein the position sensor, coupled to the piston of the differential pressure control system, has a position signal output representing the physical position of the spool within the spool valve;

supplying fluid from the hydraulic fluid supply through the spool valve to a means for transmitting rotary movement to the camshaft, the spool valve selectively allowing and blocking fluid flow through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

14. The method of claim 13, wherein the position sensor is selected from the group consisting of a linear potentiometer, a hall effect sensor, and a tape end sensor.

15. The method of claim 13, wherein the variable cam timing system further comprises:

a pulse width modulated (PWM) valve having an electrical input and a sensor coupled to the spool such that an electrical signal at the electrical input causes axial movement of the spool;

VCT phase measurement sensors coupled to the crankshaft and the at least one camshaft controlled by the variable cam timing system;

a VCT control circuit comprising:

a cam phase input coupled to the VCT phase measurement sensors;

a phase set point input for accepting a signal representing a desired relative phase of the camshaft and crankshaft;

a spool valve position input coupled to the piston of the differential pressure control system;

a signal processing circuit accepting signals from the phase set point input, the cam phase input, and the spool valve position input, such that when a phase set point signal is applied at the phase set point input, the control circuit provides an adjusted duty cycle for the pulse width modulated valve, which influences the differential pressure control system to move the spool within the spool valve to control the variable cam phaser to shift the phase of the camshaft as selected by the phase set point signal.

16. The method of claim 15, wherein the piston of the differential pressure control system and the position sensor are coupled by a means selected from the group consisting of physical coupling, an optical coupling, a magnetic coupling, and a capacitive coupling.

17. The method of claim 15, wherein the fluid comprises engine lubricating oil from a pressurized lubricating oil source.

18. The method of claim 15, in which the signal processing circuit comprises:

an outer loop controlling the phase angle, coupled to the set point input and the cam phase input;

an inner loop for controlling the spool valve position, coupled to the spool valve position input and the inner loop;

such that a duty cycle as set by the outer loop is modified by the inner loop based on the spool position.

19. The method of claim 18, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase compensator, a third input, and an output;

iii) a second PI controller (401) having an input coupled to the output of the combiner and an output;

iv) a PWM valve (206) having an input coupled to the output of the second PI controller, an input from the fluid input controller and an output; and v) a DPCS (234) having an input coupled to the output of the PWM valve (206), an input from the supply (230), and an output; and b) the inner loop comprises coupling the spool position input to the third input of the combiner.

20. The method of claim 13, wherein the piston of the differential pressure control system and the position sensor are coupled by a means selected from the group consisting of physical coupling, an optical coupling, a magnetic coupling, and a capacitive coupling.

* * * * *

UNITED STATES PATENT AND TRADEMARK OFFICE

CERTIFICATE OF CORRECTION

PATENT NO. : 6,792,902 B2
DATED : September 21, 2004
INVENTOR(S) : Simpson

It is certified that error appears in the above-identified patent and that said Letters Patent is hereby corrected as shown below:

Column 7,
Line 4, “cain” should be -- cam --

Column 8,
Line 3, “ail” should be -- an --
Lines 27 and 37, “in-put” should be -- input --

Column 9,
Line 65, “in-put” should be -- input --

Signed and Sealed this

Twenty-fifth Day of January, 2005

JON W. DUDAS
*Director of the United States Patent and Trademark Office*